United States Patent [19]

Currie

[11] 4,102,104

[45] Jul. 25, 1978

[54] FRAME MEMBER

[75] Inventor: Matthew Porter Currie, "Osborne" Ivybank Crescent, Port Glasgow, Great Britain

[73] Assignees: Matthew Porter Currie, Port Glasgow; John Victor Malarkey, Newton Mearns, both of Great Britain; part interest to each

[21] Appl. No.: 721,822

[22] Filed: Sep. 9, 1976

[30] Foreign Application Priority Data

Sep. 13, 1975 [GB] United Kingdom ..... 37721/75

[51] Int. Cl.[2] ..... E04B 5/52

[52] U.S. Cl. ..... 52/494

[58] Field of Search ..... 52/494, 474, 497

[56] References Cited

U.S. PATENT DOCUMENTS

| | | | |
|---|---|---|---|
| 2,754,776 | 7/1956 | Blaski | 52/494 X |
| 2,857,631 | 10/1958 | Zingone | 52/494 X |

FOREIGN PATENT DOCUMENTS

| | | | |
|---|---|---|---|
| 112,766 | 1/1969 | Denmark | 52/494 |

*Primary Examiner*—J. Karl Bell

*Attorney, Agent, or Firm*—Gerald J. Ferguson, Jr.; Joseph J. Baker

[57] ABSTRACT

A frame member for use in constructing a framework, particularly but not exclusively for use in the construction of a suspended ceiling or partitioning framework having a side face which has a first projecting bearing portion and a first surface extending from the first bearing portion, the first surface having at least a portion which tapers inwardly, the frame member having an end face which has a second projecting bearing portion coplanar with and presented in a direction opposite to the first bearing portion and a second surface extending from the second bearing portion adjacent said first surface and having a portion of complementary taper to the tapered portion of the first surface.

9 Claims, 6 Drawing Figures

FRAME MEMBER

The present invention relates to a frame member for use in the construction of a framework, particularly but not exclusively for use in the construction of a suspended ceiling or partitioning framework.

One previously proposed framework is made up from inverted T-section metal members arranged in a grid formation, ceiling tiles or the like being supported on the flanges of the members.

Whereas this arrangement has proved to a certain extent to be satisfactory it has serious drawbacks in that the connection between the various members and the framework has in some instances been complicated and certainly involves some form of fastening means, for example, screws and clips.

Furthermore, frameworks of this nature in suspended ceilings can be time-consuming in erection and difficult to dismantle to permit access to various services, for example lighting and ventilation arranged above the suspended ceiling.

Some ceilings of this nature do not have a particularly good appearance owing to the difficulties in providing a neat joint between the frame members.

A further type of suspended ceiling employed heretofore utilises frame members which, on erection of the ceiling, are concealed. Ceiling tiles for use with such a ceiling are provided at their edges with upstanding sides and these sides clip into clips provided on the underside of the frame members. Erection of these ceilings is also difficult and time-consuming and it has been found that the clip arrangement is not entirely satisfactory, thereby leading to a loosening of the tiles which gives an uneven appearance to the ceiling, quite apart from the fact that the ceiling may be dangerous.

A general drawback of some existing suspended ceilings is their high cost, not only due to the lengthy erection process but also as a result of the complicated manufacturing and machining operations which have to be carried out on the framework, the frame member joints and the ceiling tiles.

It is an object of the present invention to obviate or mitigate these disadvantages.

According to the present invention there is provided an elongate frame member having a side face which has a first projecting bearing portion extending therealong and a first surface extending from the first bearing portion, the first surface having at least a portion which tapers inwardly, the frame member having an end face which has the end face portion tapering outwardly at the same taper angle as the tapered portion of the first surface, having a second bearing portion coplanar with and presented in a direction opposite to the first bearing portion so that the second bearing portion of the end face of one such frame member can rest against the first bearing portion of the side face of another frame member with their respective tapered portions engaging one another.

The first surface may be planar or of functional or ornamental configuration.

Preferably each side face of the frame member has a first bearing portion and a first surface extending therefrom.

Preferably each end face of the frame member has a second bearing portion and a tapered portion.

The first surface may taper in a stepwise, planar or curved manner.

Preferably the frame member is machined from wood, or made of plastics material or extruded aluminium.

Further according to the present invention there is provided a framework including a plurality of first frame members forming parallel runners, and second frame members forming cross-members supported by said runners, the runners and cross-members each having a side face which has a first projecting bearing portion extending therealong and a first surface extending from the first bearing portion, the first surface having at least a portion which tapers inwardly, and the end faces of at least the cross-members each having a portion tapering outwardly at the same taper angle as the tapered portion of the first surface and a second bearing portion coplanar with and presented in a direction opposite to the first bearing portion, the second bearing portions of the end faces of the cross-members resting against the first bearing portions of the side faces of the runners with their respective tapered portions engaging one another.

Preferably the cross-members are arranged substantially at right-angles to the runners.

Preferably also the runners are equispaced.

The framework may be horizontal and suspended from, for example, an existing ceiling structure to form a suspended ceiling above which lighting and other services can be disposed. If desired, ceiling tiles can be arranged between adjacent runners and cross-members, being supported at their edges by said first bearing portions.

As an alternative, the framework may be vertical and fixed to a wall and/or ceiling structure to form a partitioning framework, in which case sheets of partitioning material may be arranged between adjacent runners and cross-members, their edges being held against said first bearing portions by retaining means. The retaining means may be in the form of, for example, nails or screws inserted in the framework after positioning of the sheets, or catches mounted on the framework and pivotable between a first position which permits insertion or removal of the sheets and a second position in which the catches lock the sheets in place.

When the framework is used in partitioning, the runners and cross-members may each have two opposed first bearing portions on at least one side face and two of the first surfaces extending one from each of the first bearing portions. In this way the first surfaces are presented to view one on each side of the partitioning sheets.

Embodiments of the present invention will now be described by way of example with reference to the accompanying drawings, in which.

Figure 1:
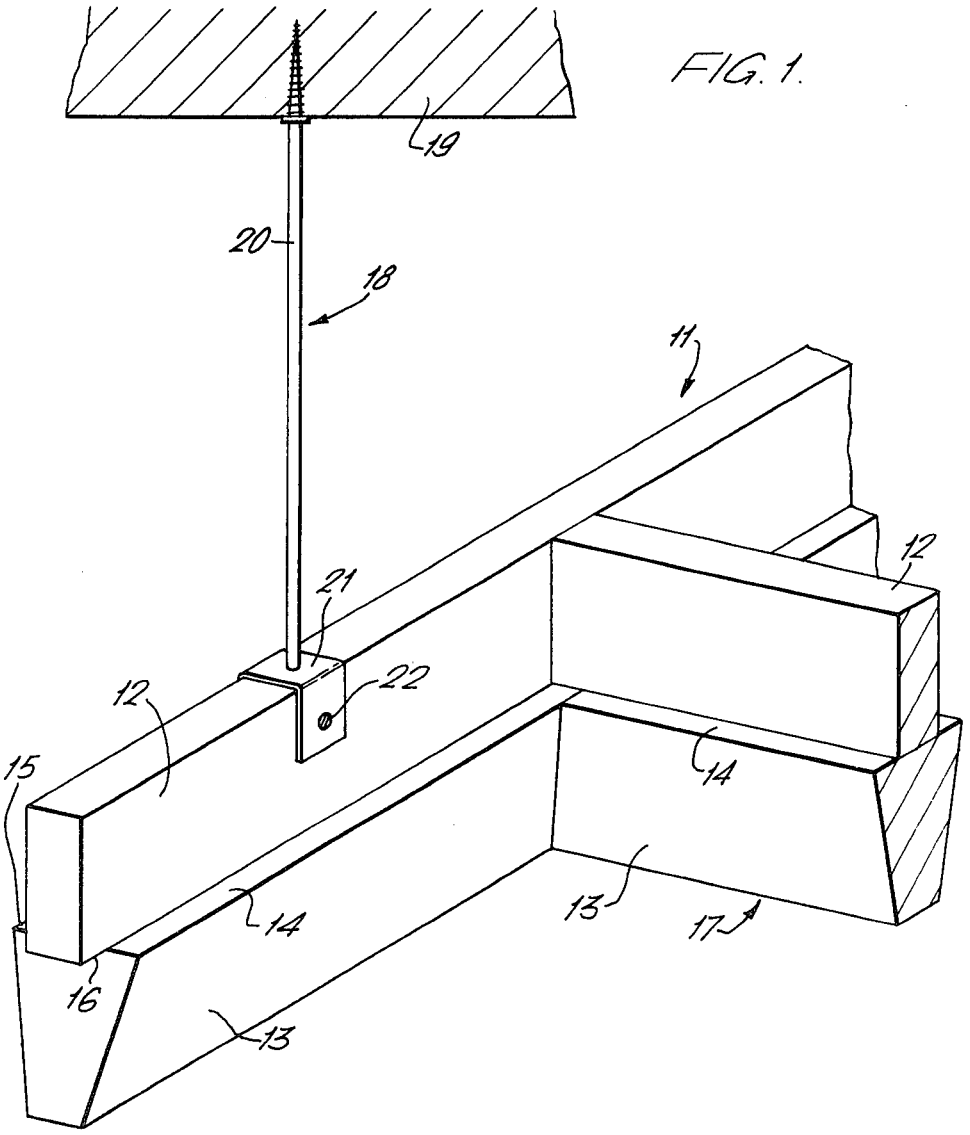
FIG. 1 is a perspective view of end portions of two frame members for use in a framework of the invention, showing how the frame members abut one another in use, and also showing means for fixing one of the frame members to a ceiling support.
Figure 2:
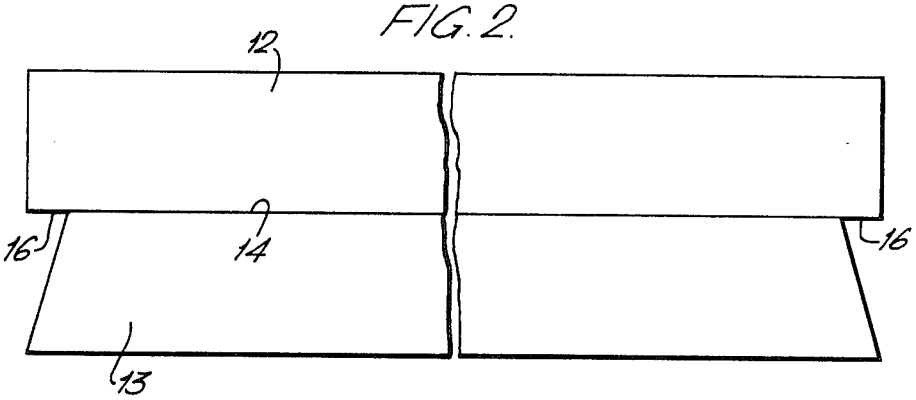
FIG. 2 is a fragmentary plan view of a frame member of the invention.
Figure 3:
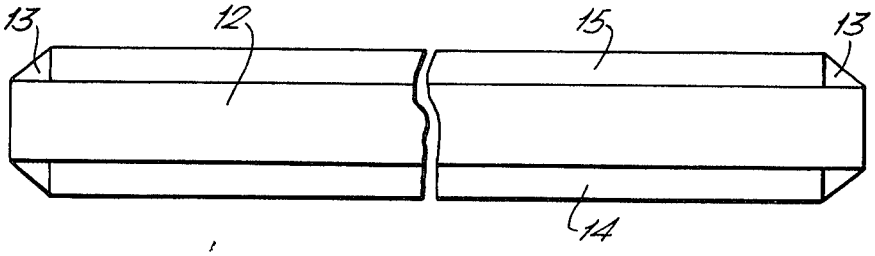
FIG. 3 is a fragmentary side view of the frame member of FIG. 3.
Figure 4:
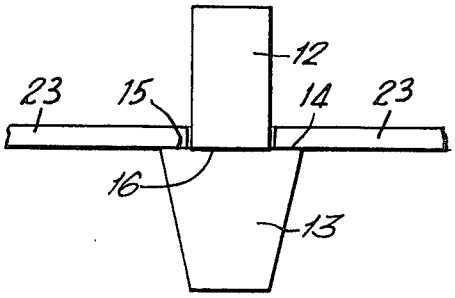
FIG. 4 is an end view of the frame member of FIG. 3 showing how ceiling tiles may be supported by the frame member.

FIGS. 1 to 4 show a frame member in the form of an integral wooden main runner 11 comprising an upper portion 12 of rectangular cross-section which surmounts a lower portion 13 of trapezoidal cross-section. The upper and lower portions 12, 13 are of similar height, and the upper face of the lower portion 13 is divided equally by the upper portion 12 to form two steps each having an upwardly-directed bearing surface portion 14, 15 from which the side faces of the lower portion 13 taper inwards.

At each of the end faces of the runner 11 the upper portion 12 overlaps the upper face of the lower portion 13 to form a further step having a downwardly-directed bearing surface portion 16 of the same width as each of the bearing surfaces 14, 15. Downwards from the bearing surface 16 the end face of the lower portion 13 is inclined outwardly at an angle equal to the angle of taper of each of the side faces. By virtue of the shapes of the end and side faces, frame members can be abutted as shown in FIG. 1 wherein the downwardly-directed bearing surface 16 of a cross-member 17 of the same configuration as the runner 11 rests on the upwardly-directed face 14 of the runner 11, the end face of the cross-member 17 being complementary to the side face of the runner 11 to form a dove-tail arrangement.

If the end face of the runner 11 is not to abut a further frame member, the end face can be made planar or of some other suitable shape, in order to abut a wall of a room.

Ties 18, of which only one is shown, are provided to suspend the runner 11 of FIG. 1 from an existing ceiling structure such as a joist 19. The tie 18 is in the form of a metal rod 20 having its upper end screw-threaded for engagement with the joist 19 and its lower end carrying a downwardly-facing U-shaped bracket 21 which fits over the upper portion 12 of the runner 11 and is attached thereto by a bolt 22 or similar fixing means.

Figure 5:
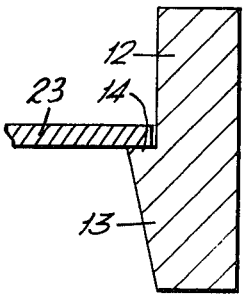
FIG. 5 is an end section of a frame member of the invention in which only one side face has a first bearing portion and inwardly-tapered surface, with a ceiling tile mounted thereon.

In FIG. 5 is shown an end runner which has one side face flat, this runner being suitable for use as a peripheral frame member in the framework.

The length of the runner 11 depends upon the desired length of the framework.

When the framework is to be used in a suspended ceiling, several runners 11 can be suspended from joists in parallel and cross-members 17 can then be fitted between adjacent runners 11 and supported therein. When the cross-members 17 are in position, downwards movement thereof is prevented by the interengagement of the downwardly-directed bearing surfaces 16 of the cross-members and the upwardly-directed bearing surfaces 14 of the runners 11, while upwards movement of the cross-members 17 is prevented by the interengagement of the tapered surfaces of the lower portions 13 of the runners 11 and the outwardly-inclined surfaces of the end faces of the cross-members 17.

If desired, ceiling tiles 23 (FIGS. 3, 4) can be positioned between the frame members so that the tiles rest on the bearing surfaces 14 of the runners 11 and cross-members 17. Only the lower portion 13 of the frame members is then visible from below, the upper portion 12 being concealed above the tiles.

To fit a suspended ceiling of the type described in the present embodiment end runner members and the main runner members 11 are first fitted and starting from one end a ceiling tile (not shown) is laid on three bearing surfaces 14 presented by two adjacent main runners 11 and an end runner member. A fourth bearing surface 15 is provided by a cross-member 17 which is fitted between the runner members 11 by facing it at an angle to the perpendicular between the runner members 11 with part of its downwardly-directed bearing surface 16 resting on the upwardly-directed bearing surfaces 14 of the runners 11. The cross-member 17 is then rotated about a vertical axis until it occupies a position in which its longitudinal axis is perpendicular to the longitudinal axis of the runners 11. This rotation causes a slight outward movement of the runners 11 but once the cross-member 17 occupies its correct position this displacement disappears.

If necessary the cross-member 17 can then be slid into position such that its upwardly-directed bearing surface 15 supports the fourth edge of the ceiling tile 23.

This operation is repeated until the ceiling is completed.

From the description given above it will be obvious that the only fixing means required are the ties 18 for suspending the main runner members 11 and means for locating the end runners and furthermore joints are virtually invisible as there are no spaces between the end face of a cross-member 17 and the side face of the adjacent runner 11.

It will also be clear that it is a simple matter partially to dismantle the ceiling to provide access to services above the ceiling. All that need be done is to remove a tile 23 by pushing it upwardly and then remove the cross-member 17 in a manner opposite to that described above during thereof.

Whereas the embodiment described above utilises wooden frame members, other material such for example as extruded aluminium or plastics member can be employed.

Furthermore the embodiment above describes the lower portion 13 as having a planar downwardly and inwardly extending side surface; however, it should be realised that this surface can be of any shape provided that it presents at least a portion which tapers inwardly, and the lower portion 13 can therefore be made in any desired functional or ornamental shape, such for example as part cylindrical.

Figure 6:
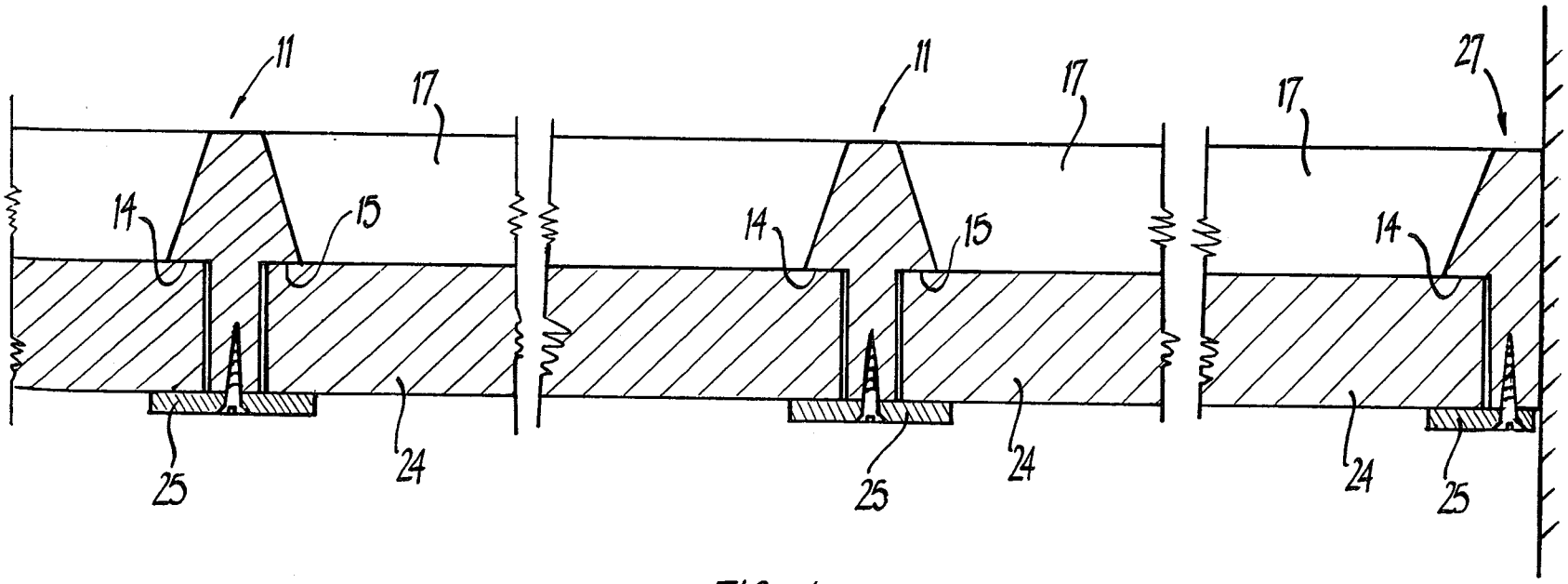
FIG. 6 is a cross-sectional view illustrating the frame members of this invention in use with partitioning.

Partitioning can be formed from frame members such as those shown in FIGS. 2 to 5, in which case the method of assembly is similar to that for a suspended ceiling except that the framework is vertical instead of horizontal and the spacing between the runners 11 is sufficient to accomodate sheets 24 (FIGS. 6) of partitioning material. The sheets 24 (FIG. 6) are held against the bearing surfaces 14, 15 by, for example, swivelable catches 25. In partitioning of this embodiment, the end runners 27 are fixed to the face of an existing wall and, if desired, to an existing floor and ceiling, by nails, screws or the like. A partition wall can then be assembled rapidly and easily between the end runners 27.

In order that the partitioning may have a pleasant appearance from front and back the frame members may be made symmetrical about a plane through the centre of the upper portion 12 parallel to the bearing surfaces 14, 15, by providing the frame members with a further portion of the shape of an inverted lower portion 13 extending along the face of the upper portion 12 remote from the lower portion 13. Alternatively the further portion may be of different configuration to the lower portion 13 provided that it has a step and inwardly-inclined surface to provide a secure joint between the runners and cross-members.

While the above embodiments relate to suspended ceiling and partitioning frameworks, the framework of this invention can be used in many other fields, such for example as in supporting wall tiles or the like.

What we claim is:

1. An elongate frame member having a side face which has a first projecting bearing portion extending therealong a first surface extending from the first bearing portion, the first surface having at least a portion which tapers inwardly, the frame member having an end face which has a portion tapering outwardly at the same taper angle as the tapered portion of the first surface, the end face having a second bearing portion coplanar with and presented in a direction opposite to the first bearing portion so that the second bearing portion of the end face of one such frame member can rest against the first bearing of the side face of another such frame member with their respective tapered portions engaging one another.

2. A frame member as claimed in claim 1, wherein the first surface is planar.

3. A frame member as claimed in claim 1, wherein both side faces have a first bearing portion and a first surface.

4. A frame member as claimed in claim 3, comprising a first elongate part of rectangular cross-section disposed co-axially with a second elongate part of trapezoidal cross-section extending along one of the faces of the first part.

5. A frame member as claimed in claim 1 made of a material selected from wood, extruded aluminium and plastics material.

6. A framework including a plurality of first frame members forming parallel runners, and second frame members forming cross-members supported by the runners, the runners and cross-members each having a side face which has a first projecting bearing portion extending therealong and a first surface extending from the first bearing portion, the first surface having at least a portion which tapers inwardly and the end faces of at least the cross-members each having a portion tapering outwardly at the same taper angle as the tapered portion of the first surface and a second bearing portion coplanar with and presented in a direction opposite to the first bearing portion, the second bearing portions of the end faces of the cross-members resting against the first bearing portions of the side faces of the runners with their respective tapered portions engaging one another.

7. A framework as claimed in claim 6, wherein the framework is horizontal and tiles are provided between adjacent runners and cross-members, the tiles being supported at their edges by the first bearing portions.

8. A framework as claimed in claim 6, wherein the framework is vertical and sheets of partitioning material are arranged between adjacent runners and cross-members, the sheets abutting at their edges the first bearing portions.

9. A framework as claimed in claim 6, wherein the cross-members are at right-angles to the runners.

* * * * *